US008132287B2

(12) United States Patent
Ting

(10) Patent No.: US 8,132,287 B2
(45) Date of Patent: Mar. 13, 2012

(54) CLEANING DEVICE WITH CLEANING MEANS AND A FRAME BODY

(75) Inventor: Ming-Che Ting, Hualien Hsien (TW)

(73) Assignee: Dikai International Enterprise Co., Ltd., Tauyuan, Tauyuan County (TW)

( * ) Notice: Subject to any disclaimer, the term of this patent is extended or adjusted under 35 U.S.C. 154(b) by 116 days.

(21) Appl. No.: 12/155,349

(22) Filed: Jun. 3, 2008

(65) Prior Publication Data

US 2009/0139043 A1 Jun. 4, 2009

(30) Foreign Application Priority Data

Nov. 30, 2007 (TW) ..... 96220375 U

(51) Int. Cl.
*A46B 3/00* (2006.01)

(52) U.S. Cl. ..... 15/226; 15/180; 15/181; 15/183; 15/190; 15/190.1; 15/194; 15/195; 15/198; 15/206; 15/DIG. 3

(58) Field of Classification Search ..... 15/226, 15/180, 181, 183, 147.1, 159.1, 190, 191.1, 15/194, 195, 198, DIG. 3
See application file for complete search history.

(56) References Cited

U.S. PATENT DOCUMENTS

| | | | | |
|---|---|---|---|---|
| 770,588 | A * | 9/1904 | Koch | 15/209.1 |
| 2,283,293 | A * | 5/1942 | Steicrt | 15/200 |
| 3,818,534 | A * | 6/1974 | Boucherie | 15/195 |
| 4,092,758 | A * | 6/1978 | Horton et al. | 15/180 |
| 4,611,359 | A * | 9/1986 | Bivens | 15/97.3 |
| 2007/0006412 | A1 * | 1/2007 | Soller et al. | 15/223 |

* cited by examiner

*Primary Examiner* — Robert Scruggs

(74) *Attorney, Agent, or Firm* — Morris Manning & Martin LLP; Tim Tingkang Xia, Esq.

(57) ABSTRACT

The present invention relates to a cleaning device comprising cleaning means and a frame body. The frame body is provided with a plurality of connecting holes, wherein each connecting hole is constituted by a larger diameter hole and a smaller diameter hole, such that a twisted cleaning means with flexibility is folded to stuff through the connecting holes from the smaller diameter hole to the larger diameter hole. The folded twisted cleaning means with flexibility then is pulled back so as to bind the twisted cleaning means with flexibility in the frame body.

4 Claims, 3 Drawing Sheets

CLEANING DEVICE WITH CLEANING MEANS AND A FRAME BODY

FIELD OF THE INVENTION

The present invention relates to a cleaning device comprising cleaning means and a frame body. The frame body is provided with a plurality of connecting holes, wherein each connecting hole is constituted by a larger diameter hole and a smaller diameter hole, such that a twisted cleaning means with flexibility is folded to stuff through the connecting holes from the smaller diameter hole to the larger diameter hole. The folded twisted cleaning means with flexibility then is pulled back so as bind the twisted cleaning means in the frame body.

BACKGROUND OF THE INVENTION

When the cleaning means such as cotton cloth strip is fixed in a frame body, the cleaning means is easily loose. In addition, the cost to bind the cleaning means is another concern. Therefore, the present invention is to provide a cleaning device that have the cleaning means to bind in the frame body in a most effective way and saves cost. The cleaning device is wildly applicable. For example, users can either use the cleaning device as a mop head to connect with connecting means of a mop so as to use as a mop, or directly equipped a fastening hole in the cleaning device to attach the cleaning device with the mop stick so as to use as a mop, or directly hold the cleaning device to clean a glass for example.

SUMMARY OF THE INVENTION

The present invention relates to a cleaning device comprising cleaning means and a frame body. The frame body is provided with a plurality of connecting holes, wherein each connecting hole is constituted by a larger diameter hole and a smaller diameter hole, such that a twisted cleaning means with flexibility is folded to stuff through the connecting holes from the smaller diameter hole to the larger diameter hole. The folded twisted cleaning means with flexibility then is pulled back so as to bind the twisted cleaning means in the frame body.

DETAILED DESCRIPTION OF THE INVENTION

FIG. 1 and FIG. 2 show a frame body 10 of the present invention. The frame body 10 has a front surface 151 and a rear surface 152 defining a middle portion 12 and a peripheral portion 13 therebetween, a plurality of engagement ribs 132 distantly formed on a peripheral edge 131 of the peripheral portion 13, and a plurality of connecting holes 11 provided in the peripheral portion 13 and extended from the front surface 151 through the rear surface 152. Each connecting hole 11 is constituted by an individual larger diameter cylindrical hole 111 and an individual smaller diameter cylindrical hole 112 coaxially connecting with one another. The individual smaller diameter cylindrical holes 112 are separated from one another and are open on the front surface 151 of the frame body 10. The individual larger diameter cylindrical holes 111 are separated from one another and are open on the rear surface 152 of the frame body 10. The middle portion 12 is surrounded by the peripheral portion 13 and indented from both the front and rear surfaces 151 and 152 of the frame body 10. The peripheral edge 131 of the peripheral portion 13 has a round profile 133 extending from the front surface 151 to the rear surface 152 of the frame body 10. The plurality of engagement ribs 132 and the round profile 133 of the peripheral edge 131 of the peripheral portion 13 are adapted for releasably engaging the frame body 10 with a handle (not shown) of the cleaning device.

As shown in FIG. 3A, a plurality of bundles of the twisted cleaning means 30 such as cloth mop strips are folded at folding point V to be a bundle of twisted cleaning means 30. The number of the bundle of the twisted cleaning means 30 corresponds to the number of the connecting holes 11 provided in the peripheral portion 13 of the body frame 10 of the cleaning device of the present invention.

As shown in FIG. 3B, each bundle of the above folded cleaning means 30 is stuffed into a respective connecting hole 11 from the folding point V such that the folded cleaning means 30 passes through the smaller diameter cylindrical hole 112 to reach the larger diameter cylindrical hole 111, and then passes through the connecting cylindrical hole 11. In FIG. 3B, the convex portion with a top portion marked with V can be seen. Since the cleaning means 30 such as cloth mop strips are flexible, the convex portion that passes through the smaller diameter cylindrical hole 112 and the larger diameter cylindrical hole 111 becomes expanded. Especially, the bundle of the cleaning means 30 that passes through the larger diameter cylindrical hole 111 becomes more expanded.

As shown in FIG. 3C, the bundle of the cleaning means 30 are then pulled back from the situation as shown in FIG. 3B, so that the expanded convex portion is pulled back so as to bind the cleaning means 30 in the frame body 10. That is, as assembled, said folding point V of the bundle of the cleaning means 30 is completely accommodated within said corresponding individual larger diameter cylindrical hole 111 of the respective connecting hole 11, and said free ends of the bundle of the cleaning means 30 are extended outwards from said folding point V through said smaller diameter cylindrical hole 112 and the front surface 151 of said frame body 10.

For the flexibility of the cleaning means 30, the cleaning means 30 are closely secured with the frame body 10 after the cleaning means 30 is pulled back as shown in FIG. 3B. In one preferred embodiment, if the diameter of folded point V in FIG. 3A is not bigger than the diameter of larger diameter hole 111, then the cleaning means 30 can be closely binding in the frame body 10. The folded point V is decided depending on the necessity. For example, if the cleaning means 30 with less density cloth mop strips is desired, the folded point V can de decided with a shorter distance from the end of the strips.

In another embodiment, the inner surface of the larger diameter hole 111 and the inner surface of the smaller diameter hole 112 can be arranged with a plurality of tooth convex so as to enhance higher friction coefficient for the connecting holes 11.

In FIG. 4, it shows the cleaning device of the present invention, wherein the cleaning means 30 are properly bound in the frame body 10.

Figure 1:
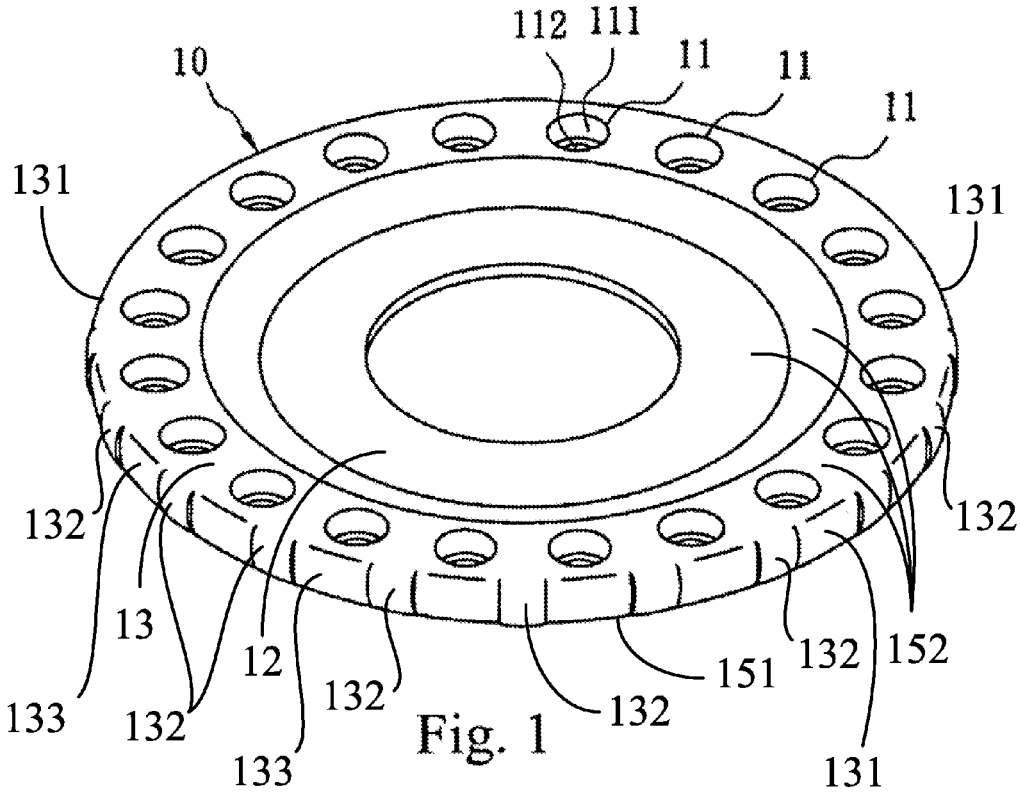
FIG. 1 is a perspective view showing the cleaning device comprising the cleaning means and a frame body in the present invention.
Figure 2:
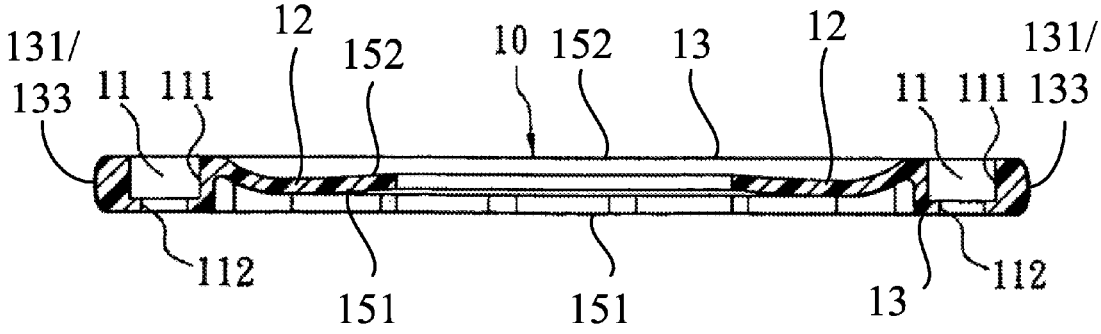
FIG. 2 is a side view showing the cleaning device comprising the cleaning means and a frame body in the present invention.
Figure 3A:
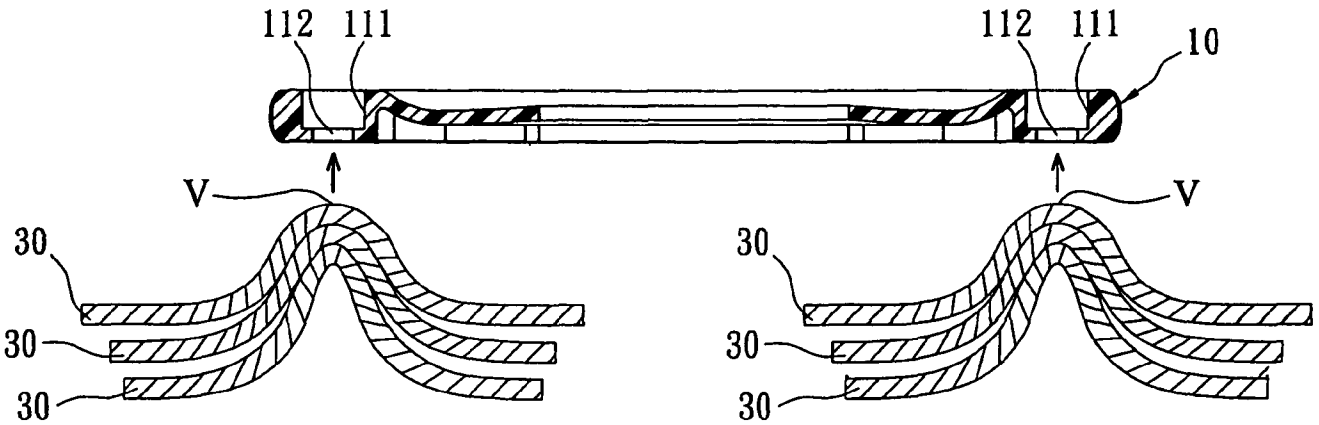
FIG. 3A, FIG. 3B and FIG. 3C are the processing views that shows how the cleaning means passes through the frame body in the present invention.
Figure 3B:
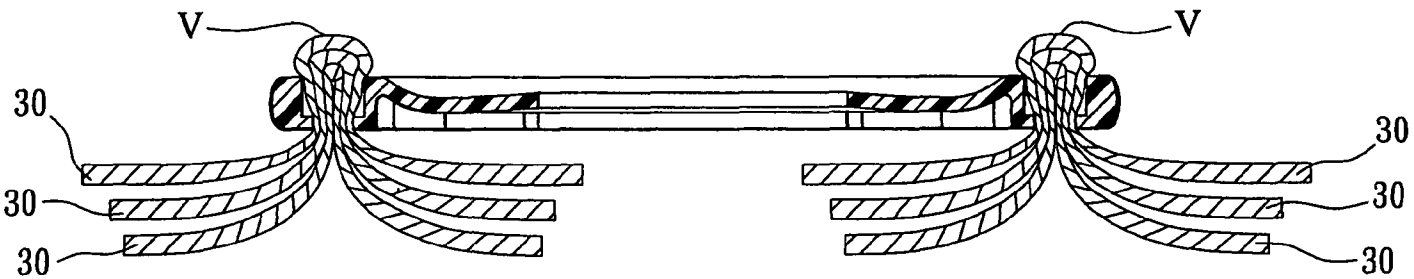
Figure 3C:
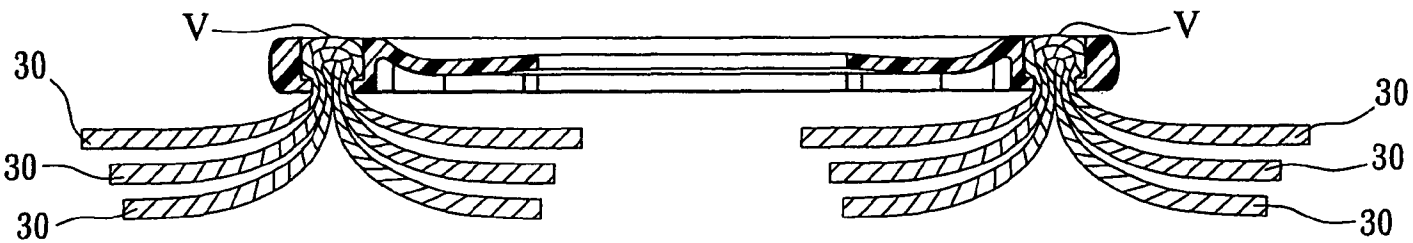
Figure 4:
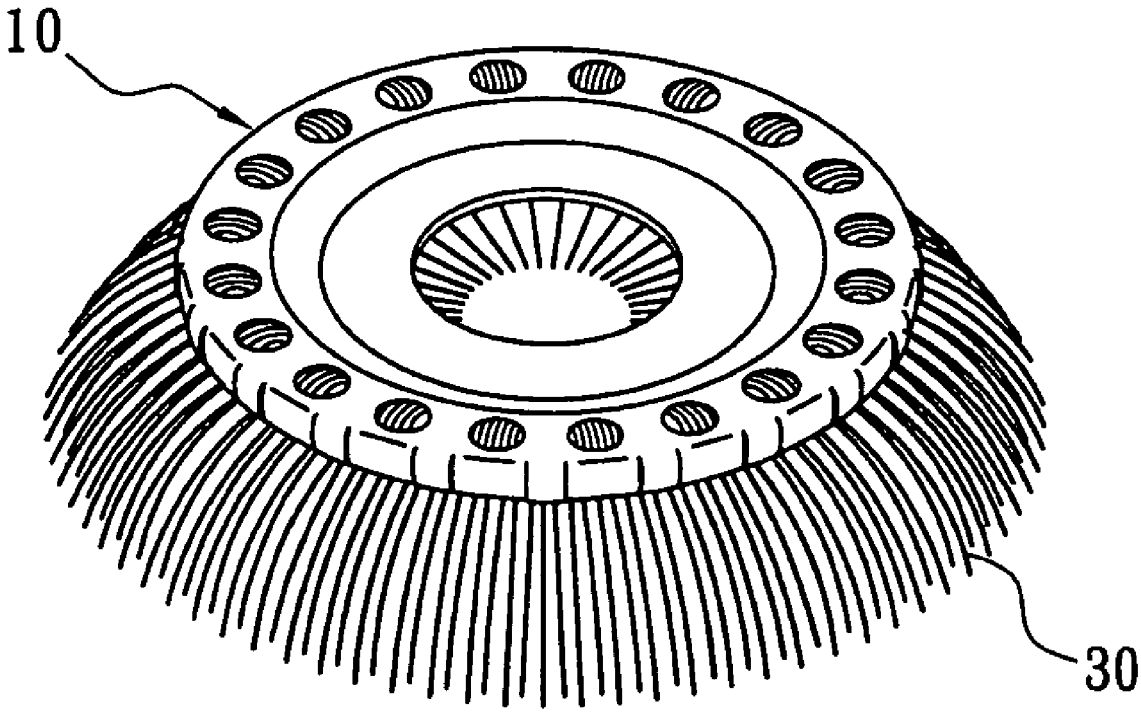
FIG. 4 shows the cleaning device after the cleaning means is properly bound with a frame body in the present invention.

The invention claimed is:

1. A cleaning device comprising:

a frame body having a front surface and a rear surface defining a middle portion and a peripheral portion therebetween, a plurality of engagement ribs distantly formed on a peripheral edge of the peripheral portion, and a plurality of connecting holes provided in the peripheral portion and extended from the front surface through the rear surface, each connecting hole comprising an individual larger diameter cylindrical hole and an individual smaller diameter cylindrical hole coaxially connected with one another, wherein the individual smaller diameter cylindrical holes are separated from one another and are open on the front surface of the frame body, and the individual larger diameter cylindrical holes are separated from one another and are open on the rear surface of the frame body, wherein the middle portion is surrounded by the peripheral portion and indented from both the front and rear surfaces of the frame body, and wherein the peripheral edge of the peripheral portion has a round profile extending from the front surface to the rear surface of the frame body; and a plurality of bundles of cloth mop strips each twisted and folded to define a folding point between free ends of the cloth mop strips, wherein each bundle of cloth mop strips is disposed in a respective connecting hole of said frame body such that each folding point is protruded from the corresponding individual smaller diameter cylindrical hole into the corresponding individual larger diameter cylindrical hole of the respective connecting hole and accommodated within said individual larger diameter cylindrical hole of the respective connecting hole with said free ends extended outwards from said folding point through said smaller diameter cylindrical hole of the respective connecting hole and the front surface of said frame body;

wherein an inner side wall of each individual larger diameter cylindrical hole exclusively contacts and compresses the folding point of a corresponding bundle of cloth mop strips to retain the folding point proximate to a corresponding individual smaller diameter cylindrical hole such that said folding point is completely accommodated within said corresponding individual larger diameter cylindrical hole of the respective connecting hole; and wherein the plurality of engagement ribs and the round profile of the peripheral edge of the peripheral portion are adapted for releasable engaging the frame body with a handle of the cleaning device.

2. A cleaning device as claimed in claim 1, wherein an inner surface of each individual smaller diameter cylindrical hole is provided with a plurality of tooth convex so as to enhance an inner surface friction of the connecting holes.

3. A cleaning device as claimed in claim 1, wherein an inner surface of each individual larger diameter cylindrical hole is provided with a plurality of tooth convex so as to enhance an inner surface friction of the connecting holes.

4. A cleaning device as claimed in claim 1, wherein an inner surface of each individual larger diameter cylindrical hole and an inner surface of each individual smaller diameter cylindrical hole are both provided with a plurality of tooth convex so as to enhance inner surface frictions of the connecting holes.

* * * * *